US010669773B2

(12) United States Patent
Grube

(10) Patent No.: US 10,669,773 B2
(45) Date of Patent: Jun. 2, 2020

(54) ADJUSTABLE ASSEMBLY DOUBLE STABILIZED SCREEN DOOR

(71) Applicant: Richard Paul Grube, Taylors, SC (US)

(72) Inventor: Richard Paul Grube, Taylors, SC (US)

( * ) Notice: Subject to any disclaimer, the term of this patent is extended or adjusted under 35 U.S.C. 154(b) by 156 days.

(21) Appl. No.: 15/708,347

(22) Filed: Sep. 19, 2017

(65) Prior Publication Data

US 2019/0085619 A1 Mar. 21, 2019

(51) Int. Cl.

| | |
|---|---|
| ***E06B 9/52*** | (2006.01) |
| ***E06B 3/98*** | (2006.01) |
| ***E06B 3/964*** | (2006.01) |
| ***E06B 7/32*** | (2006.01) |
| *E06B 3/972* | (2006.01) |

(52) U.S. Cl.

CPC ..... *E06B 3/98* (2013.01); *E06B 3/9642* (2013.01); *E06B 7/32* (2013.01); *E06B 9/52* (2013.01); *E06B 3/972* (2013.01); *E06B 2009/527* (2013.01)

(58) Field of Classification Search

CPC ..... E06B 3/98; E06B 3/982; E06B 3/9636; E06B 3/9646; E06B 3/972; E06B 2009/527; E06B 2009/524; E06B 9/52

See application file for complete search history.

(56) References Cited

U.S. PATENT DOCUMENTS

| | | | | |
|---|---|---|---|---|
| 355,969 A | | 1/1887 | Boughton | |
| 643,889 A | | 2/1900 | Wheeler | |
| 1,431,071 A | | 10/1922 | Willhoite | |
| 1,445,425 A | * | 2/1923 | Van Fleet | E06B 3/984 403/376 |
| 3,058,518 A | * | 10/1962 | Housman | E06B 3/285 160/380 |
| 3,220,469 A | * | 11/1965 | Oehmig | E06B 9/52 160/380 |
| 3,375,030 A | * | 3/1968 | Thompson | B62D 33/044 403/231 |
| 3,673,674 A | * | 7/1972 | Catulle | E06B 3/9646 29/464 |
| 3,716,890 A | * | 2/1973 | Benson | A47H 15/00 16/91 |
| 3,782,064 A | * | 1/1974 | Hubbard | E04B 1/70 52/97 |
| 3,798,863 A | * | 3/1974 | Latson | E04B 2/766 52/204.597 |
| 3,808,758 A | * | 5/1974 | Burgers | E06B 1/04 52/212 |

(Continued)

FOREIGN PATENT DOCUMENTS

DE 102015108275 A1 12/2016

OTHER PUBLICATIONS

Affordable Screen Co., Classic Sliding Screen Door Kit, http://www.affordablewindowscreens.com/index.php?page=shop.product_details&flypage=vmj_naru.tpl&product_id=295&category.

(Continued)

*Primary Examiner* — Johnnie A. Shablack

(74) *Attorney, Agent, or Firm* — Burr & Forman LLP; Douglas L. Lineberry

(57) ABSTRACT

An adjustable assembly double stabilized screen door that forms a strong frame and requires minimal effort to assemble, disassemble and/or tighten wherein the door contains multiple stiles and rails forming joints containing mechanical tenons.

17 Claims, 15 Drawing Sheets

(56) References Cited

U.S. PATENT DOCUMENTS 3,960,197 A * 6/1976 Daniels ..... A47G 1/0605 160/371
4,116,573 A * 9/1978 Fuchs ..... F16B 5/0607 403/264
4,131,376 A * 12/1978 Busse ..... F16B 12/2036 312/263
4,161,977 A * 7/1979 Baslow ..... A47G 1/0605 160/327
4,189,880 A * 2/1980 Ballin ..... E06B 3/285 160/380
4,250,680 A * 2/1981 Bomar ..... E06B 3/30 40/783
4,299,067 A * 11/1981 Bertschi ..... E04B 1/6162 403/296
4,592,402 A * 6/1986 Spofford ..... E04C 2/38 144/346
4,599,011 A * 7/1986 Tashiro ..... F16B 12/2036 403/245
4,662,038 A * 5/1987 Walker ..... F16B 5/0692 160/392
4,899,797 A * 2/1990 Green ..... E06B 9/52 160/380
5,086,604 A * 2/1992 Orth ..... E06B 3/28 52/202
5,143,138 A * 9/1992 Zwart ..... E06B 9/521 160/369
5,261,203 A * 11/1993 Yoon ..... E06B 3/984 403/231
5,263,803 A * 11/1993 Anquetin ..... F16B 13/00 411/31
5,284,401 A * 2/1994 Harley ..... F16B 12/2009 403/231
5,301,737 A * 4/1994 Martin ..... E06B 9/52 160/380
5,363,625 A * 11/1994 Philippi ..... E04B 1/5831 52/653.2
5,375,923 A * 12/1994 Hall ..... A47B 88/956 312/330.1
5,403,109 A * 4/1995 Johnson ..... F16B 12/2036 403/231
5,567,081 A * 10/1996 Vallance ..... F16B 12/2036 403/231
5,586,400 A * 12/1996 Moore, III ..... D05C 9/04 112/103
5,590,975 A * 1/1997 Horntvedt ..... F16B 12/2036 312/348.2
5,683,198 A * 11/1997 Leutenegger ..... B62D 33/044 403/231
5,732,760 A * 3/1998 Pattison ..... E06B 3/28 160/371
5,761,860 A * 6/1998 Koike ..... E06B 3/5821 49/401
5,772,353 A * 6/1998 Grieser ..... F16B 12/2036 403/231
5,788,395 A * 8/1998 Grieser ..... F16B 12/2036 403/231
5,823,700 A * 10/1998 Poworoznek ..... F16B 12/2036 403/245
6,250,040 B1 * 6/2001 Green ..... E06B 3/72 52/455
6,378,267 B1 * 4/2002 Bass ..... E06B 9/52 160/57
6,890,121 B2 * 5/2005 Mauri ..... F16B 12/2063 403/230
6,908,252 B1 * 6/2005 Rubano ..... F16B 12/2027 403/231
6,945,305 B1 * 9/2005 Limauro ..... E06B 9/52 160/369
6,960,045 B2 * 11/2005 Schmalzhofer ..... F16B 7/187 403/252
6,973,953 B2 12/2005 Winner
7,104,016 B2 * 9/2006 Kerr ..... E06B 1/526 52/204.1
7,223,045 B2 * 5/2007 Migli ..... F16B 12/2009 29/452
7,260,919 B1 * 8/2007 Spransy ..... E04B 9/183 52/585.1
7,357,467 B2 * 4/2008 Lee ..... A47B 95/02 16/422
7,494,297 B2 * 2/2009 Brede ..... F16B 12/2009 403/231
7,698,871 B2 * 4/2010 Mansueto ..... E06B 3/9642 52/656.7
7,735,540 B2 * 6/2010 Armstrong ..... E06B 9/52 160/280
7,735,541 B2 * 6/2010 Ocampo ..... B44D 3/185 101/127.1
7,818,927 B1 * 10/2010 John ..... E06B 3/74 52/204.1
8,056,602 B1 * 11/2011 Green ..... E06B 9/52 160/392
8,353,327 B2 * 1/2013 Domingue ..... B44D 3/185 160/371
8,528,188 B2 * 9/2013 Vestergaard-Jensen ..... F16B 12/18 29/525.01
8,683,771 B2 4/2014 Sawyers et al.
8,714,863 B2 * 5/2014 Vallance ..... F16B 12/2036 403/245
8,794,864 B2 * 8/2014 Vallance ..... F16B 12/2036 403/350
8,984,821 B2 * 3/2015 Bruno ..... E06B 3/72 52/210
8,992,114 B2 * 3/2015 Ajanovic ..... F16B 12/2063 403/362
9,140,054 B2 * 9/2015 Oberbroeckling .... E06B 3/7001
9,163,454 B1 * 10/2015 Hopson ..... E06B 9/52
9,200,652 B1 * 12/2015 Laurence ..... F16B 5/0692
9,234,383 B2 1/2016 Bruno
9,366,072 B1 6/2016 Orozco Aguayo
9,410,568 B2 * 8/2016 O'Brien ..... F16B 12/14
9,482,051 B1 * 11/2016 Green ..... E06B 9/52
9,487,999 B2 * 11/2016 Seuberling ..... E06B 9/52
9,500,023 B2 11/2016 Poniros
9,518,423 B2 * 12/2016 Seuberling ..... E06B 9/52
9,732,781 B2 * 8/2017 Ajanovic ..... F16B 12/2063
10,094,164 B2 * 10/2018 Massey ..... E06B 1/34
10,161,432 B2 * 12/2018 Nitschmann ..... F16B 12/20
10,294,714 B2 * 5/2019 Massey ..... E06B 7/16
10,378,570 B2 * 8/2019 Broughton ..... F16B 12/24
10,443,635 B2 * 10/2019 Cuddy ..... F16B 12/2009
2004/0020157 A1 * 2/2004 Bass ..... E06B 9/52 52/656.7
2004/0112553 A1 * 6/2004 Minnich ..... E06B 3/28 160/378
2004/0168379 A1 * 9/2004 Chen ..... E06B 9/24 52/202
2004/0211531 A1 * 10/2004 Dybdahl ..... E06B 3/28 160/377
2004/0250486 A1 * 12/2004 Sibbett ..... E06B 3/9632 52/204.1
2005/0006038 A1 * 1/2005 Armstrong ..... E06B 9/52 160/371
2005/0016091 A1 * 1/2005 Chen ..... E06B 3/5892 52/204.1
2005/0056389 A1 * 3/2005 Kelley ..... E06B 9/52 160/371
2005/0235585 A1 * 10/2005 Green ..... E06B 3/285 52/204.5
2006/0016144 A1 * 1/2006 Jacobs ..... E05D 15/0669 52/455
2006/0157208 A1 * 7/2006 Annacchino ..... E06B 9/52 160/371
2008/0159806 A1 * 7/2008 Niswonger ..... B41F 15/36 403/231
2009/0071087 A1 * 3/2009 Achen ..... E06B 7/02 52/302.1

(56) References Cited

U.S. PATENT DOCUMENTS

| | | | | |
|---|---|---|---|---|
| 2009/0241610 | A1* | 10/2009 | Watts | E06B 3/9643 70/91 |
| 2010/0147471 | A1* | 6/2010 | Bull | E06B 9/52 160/381 |
| 2010/0287857 | A1* | 11/2010 | Kerr | E06B 1/06 52/211 |
| 2014/0130993 | A1* | 5/2014 | Zwar | E06B 5/00 160/371 |
| 2014/0230351 | A1 | 8/2014 | Andres | |
| 2019/0024451 | A1* | 1/2019 | Seuberling | E06B 9/52 |
| 2019/0085619 | A1* | 3/2019 | Grube | E06B 7/32 |
| 2019/0218850 | A1* | 7/2019 | Brown | E06B 5/11 |

OTHER PUBLICATIONS

Author Unknown, Screen Door Replacement Kit Made in the USA, http://www,fixingscreens.com/screen-door-replacement.html.

Author Unknown, New Knock Down Screen Door Kits, https://www.youtube.com/watch?v=VojfKlluzB0.

Apex Products, Standard Sliding Screen Door Kit, https://www.apexproducts.com/Item/economy_sliding_screen_door.

Author Unknown, Patio Door Kits—Patio Screen Door Replacement Kits All Types and Sizes, http://www.biltbestwindowparts.com/content/patio-door-kits-patio-screen-door-replacem.

Madden Industries, Screen Door—Bronze—Knock Down, https://www.amazon.com/Screen-Door-Bronze-Knock-Down/dp/B00NT6J86E.

* cited by examiner

ADJUSTABLE ASSEMBLY DOUBLE STABILIZED SCREEN DOOR

BACKGROUND OF THE INVENTION

1) Field of the Invention

The present invention relates to an adjustable assembly double stabilized screen door.

2) Description of Related Art

Screen doors have long been an accoutrement to homes. A screen door can refer to a hinged storm door (cold climates) or hinged screen door (warm climates) covering an exterior door, or a screened sliding door used with sliding glass doors. In any case, the screen door incorporates screen mesh to block flying insects or airborne debris such as seeds or leaves from entering, and pets and small children from exiting interior spaces, while allowing for air, light, and views. The first screen doors were made using cheesecloth. After the Civil War, wire cloth was coated with paint and sold for window screens.

Various types of screen doors exist. Aluminum framed sliding screen doors are generally constructed by two methods: rollformed or extruded. In both cases the rectangular rollformed or extruded shapes are joined together into a door frame using metal corners or screws.

Rollformed screen doors are formed from "rollforming" thin aluminum sheets into a rectangular shaped door frame which incorporates a screen channel to hold the window screen material. Rollformed aluminum sliding screen doors are the least expensive to produce because they can be manufactured from thin aluminum sheet formed into a relatively strong rectangular shape.

Rollformed screen doors have mitered corners into which a steel or aluminum alloy corner is forced using a friction fit. If a steel corner is used, the rollformed sections are often pierced or staked into the corners to help secure the corners together. If aluminum alloy corners are used, the corner relies on its friction fit alone to hold the door frame together.

The weakest point of a rollformed sliding screen door is the corner. After repeated opening and closing, stresses will cause the rollformed shape to loosen in the area of the corner. The door will then stick and jam and typically will require replacement rather than repair The second type of aluminum screen door are extruded aluminum shapes, with aluminum frames made from thicker aluminum than rollformed doors. This makes an extruded aluminum door much stronger but also more expensive. Extruded aluminum screen door frames can be mitered and joined with aluminum alloy corners or can be notched out and joined together with screws that fit in screw holes made as part of the extrusion process.

Extruded aluminum screen doors are generally longer lasting than rollformed screen doors. They are also more easily repaired since, if the corners break, new corners can be inserted without losing the friction fit necessary to hold the door together.

Wood framed screen doors, hinged and sliding, are also available from limited production and custom carpentry sources, used for aesthetic style and sustainable building applications. Wood-framed screen doors were a fixture of many homes in the American South before air conditioning was common.

Various screen doors exist in the art, for instance, U.S. Pat. No. 6,973,953 (Winner '953) discloses a screen door with four lineal door frame components, each of the lineal components has a cross-section defining an interior space extending in a longitudinal direction of the linear components. Four symmetric, L-shaped members are provided; each has a corner portion and two posts that extend from the corner portion at a right angle to one another. The posts each have a length and a plurality of fins extending therefrom along at least portions of the length. A metal reinforcement member is arranged in the hollow portion of the lineal components so as to extend substantially along the entire length of the lineal components and leave an empty portion of the hollow section at each end of the lineal components, which empty portions have a length equal to at least the length of the posts of the L-shaped body. The posts of the L-shaped members are mounted in the free hollow portions of the lineal components so that at least some of the fins engage an interior surface of the lineal components. (Abstract.)

However, Winner '953 lacks numerous elements of the current disclosure, including but not limited to, a screen affixment mechanism that covers a standing ridge of the substantially continuous spline, at least one mechanical tenon substantially entirely contained within the material of the at least one stile, and allowing for the mechanical tenon to be tightened or loosened via engaging the mechanical tenon via at least one access.

Another disclosure, U.S. Pat. No. 9,234,383 (Bruno '383) provides a modular door having at least one door panel, premanufactured stiles and at least two rails. The door is held together using rods optionally that may have at least one stabilizer that are inserted into channels formed within the door. (Abstract.) Bruno '383 also lacks numerous elements of the current disclosure, including but not limited to, a screen affixment mechanism that covers a standing ridge of the substantially continuous spline, at least one mechanical tenon substantially entirely contained within the material of the at least one stile, and allowing for the mechanical tenon to be tightened or loosened via engaging the mechanical tenon via at least one access.

U.S. Pat. No. 9,366,072 (Aguayo '072) discloses a buildable, collapsible and lightweight screen. The screen includes a frame constructed with at least two longitudinal profiles and at least two transverse profiles. The profiles have hollow extruded profiles and include at least one inner groove which runs along one side, in a longitudinal direction. Each of the profiles and one or more panels of sheet material are confined within the frame along the inside groove, and connectors align and fasten the longitudinal and transverse profiles by fasteners and connectors which act as intermediaries to avoid direct contact between these profiles. (Abstract.)

Aguayo '072 lacks many elements of Applicant's disclosure, including but not limited to, a screen affixment mechanism that covers a standing ridge of the substantially continuous spline, at least one mechanical tenon substantially entirely contained within the material of the at least one stile, and allowing for the mechanical tenon to be tightened or loosened via engaging the mechanical tenon via at least one access.

U.S. Pat. No. 355,969 (Boughton '969) discloses a screen door assembled via mortises and tenons and tongues 'K' that may be cut in order to size the door to various shaped door frames. Boughton '969, too, lacks many element of Applicant's disclosure, including but not limited to, a screen affixment mechanism that covers a standing ridge of the substantially continuous spline, at least one mechanical tenon substantially entirely contained within the material of the at least one stile, and allowing for the mechanical tenon to be tightened or loosened via engaging the mechanical tenon via at least one access.

U.S. Pat. No. 1,431,071 (Willhoite '071) discloses a screen door. The screen door frame is constructed of telescopic sections which have their inner edges rabbeted to provide a pocket for the marginal edges of a screen. Strips are received in the rabbeted portions and secured thereto for sustaining the screen on the frame and bridging the joints of the frame to effect in producing a light but strong and durable door construction. Willhoite '071 also fails to disclose various limitations of Applicant's disclosure. These include, but are not limited to, a screen affixment mechanism that covers a standing ridge of the substantially continuous spline, at least one mechanical tenon substantially entirely contained within the material of the at least one stile, and allowing for the mechanical tenon to be tightened or loosened via engaging the mechanical tenon via at least one access.

Accordingly, it is an object of the present invention to provide an easily assembled screen door or adjustable assembly that forms a strong frame and requires minimal effort and tools to assemble and disassemble. Further, the current disclosure provides a novel means for joining joints and later tightening same in the door or assembly, if the joints later become loose.

SUMMARY OF THE INVENTION

The above objectives are accomplished according to the present invention by providing a screen door. The door includes at least two rails and at least two stiles formed from a material, a substantially continuous spline forms at least one perimeter around the at least two rails and at least two stiles, a screen affixment mechanism covers a standing ridge of the substantially continuous spline, the at least two rails and at least two stiles form at least one joint, at least one mechanical tenon is substantially entirely contained within the material of the at least one stile and at least one rail forming the at least one joint. There is at least one access defined within the at least two stiles and the mechanical tenon may be tightened or loosened via engaging the mechanical tenon via the at least one access.

In a further embodiment, the at least one spline on the at least one rail extends onto the material of the at least one stile to which the at least one rail is connected. In a yet further embodiment, the screen door has at least three rails. In a still further embodiment, the joints are square cut. In a yet further still embodiment, the screen door may be disassembled via accessing the at least one mechanical tenon. In another embodiment, a screen is affixed to the spline via frictional engagement between the standing ridge and the screen affixment mechanism. In a further still embodiment, adjustment of the at least one mechanical tenon tightens or loosens the at least one joint.

In an alternative embodiment, an adjustable assembly is provided. The assembly includes at least two rails and at least two stiles formed from a material. The adjustable assembly includes at least one set of paired stabilizers: a first stabilizer is placed internally within the material of at least one joint formed by a junction of at least one rail and at least one stile and a second stabilizer is formed by overlap of a spline from a surface of at least one rail onto a surface of at least one stile over an exterior of the at least one joint. The spline forms at least one perimeter around the at least two rails and at least two stiles, and a spline cover vertically engages the spline and moves horizontally along the spline.

In a further embodiment, the at least one mechanical tenon is substantially entirely contained within the material of the at least one stile and at least one rail forming the at least one joint. In a still further embodiment, at least one access is defined within the at least two stiles. In a still yet further embodiment, the mechanical tenon may be tightened or loosened via engaging the mechanical tenon via at least one access defined in at least one stile. Still further yet, adjustment of the at last one mechanical tenon tightens or loosens the at least one joint. In another embodiment, the adjustable assembly includes at least three rails. In a yet further embodiment, the joints are square cut. In a further still embodiment, the door may be disassembled via accessing the at least one mechanical tenon. Further yet, a screen is affixed to the spline via frictional engagement between a standing ridge of the spline and a screen affixment mechanism.

In another alternative embodiment, a process for assembling a screen door is provided. The process includes joining at least two stiles with at least two rails via a plurality of mechanical tenons to form a plurality of joints, accessing the mechanical tenons via at least one access formed in the at least two stiles, tightening the mechanical tenons, wherein a substantially continuous spline forms at least one perimeter around the joined at least two stiles and at least two rails and wherein a portion of the spline attached to at least one rail extends onto at least one stile, placing a screen over an upright ridge formed by the substantially continuous spline, vertically attaching a spline cover over the screen and upright ridge in order to frictionally secure the screen between the spline cover and upright ridge without the need for other fasteners or adhesives.

In a still further embodiment, the screen door may be disassembled by loosening the mechanical tenons, separating the at least two stiles and rails, and sliding the spline cover horizontally along the spline to free the screen from frictional engagement.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
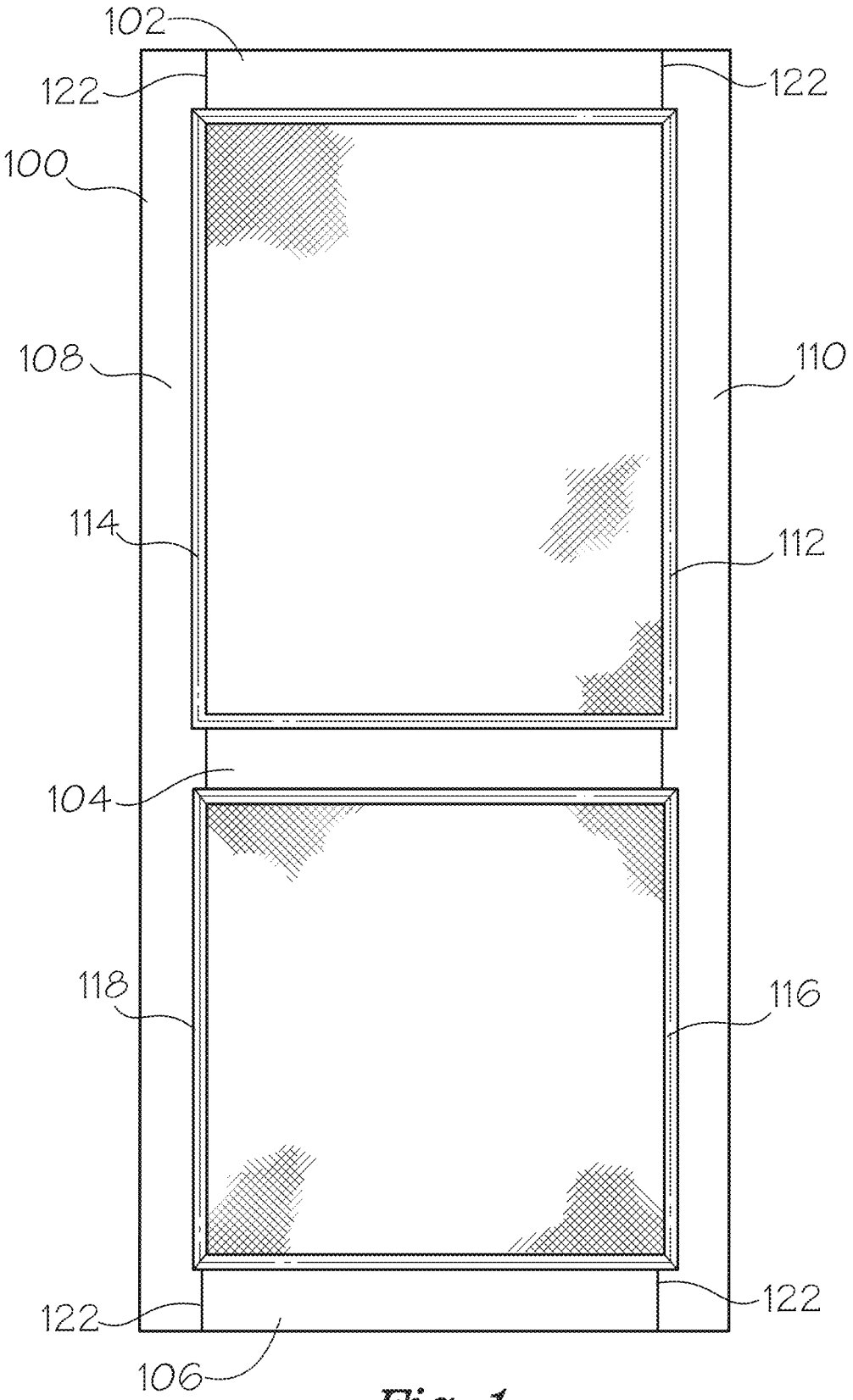
FIG. 1 shows an assembled screen door of the current disclosure.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

FIG. 1 shows an assembled screen door 100 of the current disclosure. Screen door 100 includes a first rail 102, second rail 104, and third rail 106. While three rails are shown, more or less rails are considered within the scope of this disclosure including 2, 4, 5, 6, 7 or more rails. Also, while rails 102, 104 and 106 are shown as running substantially horizontal in FIG. 1, the rails may be affixed to first stile 108 and second stile 110 at a variety of angles as well as but not limited to parallel to the stiles as well as at a range of acute/obtuse angles to the stiles ranging from 0 to 180 degrees. Also, while FIG. 1 shows only two stiles, more stiles are considered within the scope of this disclosure such as 3, 4, 5, 6, 7, or more stiles.

The rails and stiles may be formed from a material including but not limited to: wood, composites, resins, thermoplastics, plastics, ceramics, fiber formed materials, polymers, metals, 3-D printed materials, aluminum, man-made synthetics, etc., or combinations of the above, as known to those of skill in the art. In a preferred embodiment, the stiles and rails may be formed from wood. However, in other embodiments, the stiles and materials may be formed from different materials, e.g., the stiles made from plastic and the rails made from a composite material.

Screen door 100 may also include a substantially continuous spline 112 forming at least one perimeter 114 around at least a portion of the rails and stiles. Further, a second substantially continuous perimeter 116 may also be formed from a second substantially continuous spline 118. Splines 112 and 118 may be formed from wood, composites, resins, thermoplastics, plastics, ceramics, fiber formed materials, polymers, metals, 3-D printed materials, etc., or combinations of the above, as known to those of skill in the art. In a preferred embodiment, the spline may be formed from aluminum. Rails 102, 104, 106 and stiles 108 and 110 join to form joints 122. Joints 122 may be square cut or angled or coped or mitered. In a preferred embodiment, joints 122 are square cut.

Figure 2A:
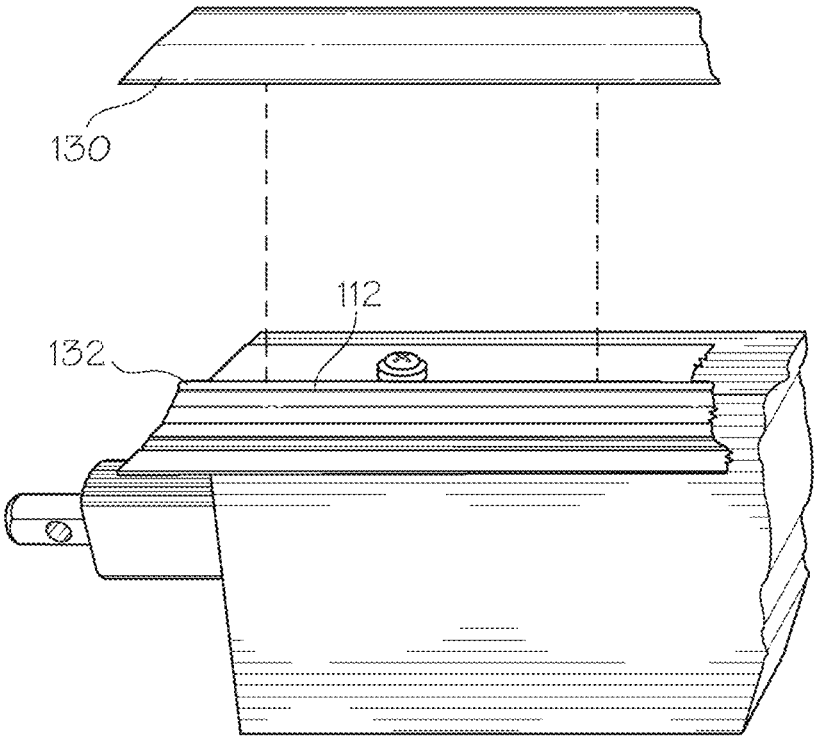
FIG. 2A shows an end view of a rail with the screen affixment mechanism separated from the standing ridge.
Figure 2B:
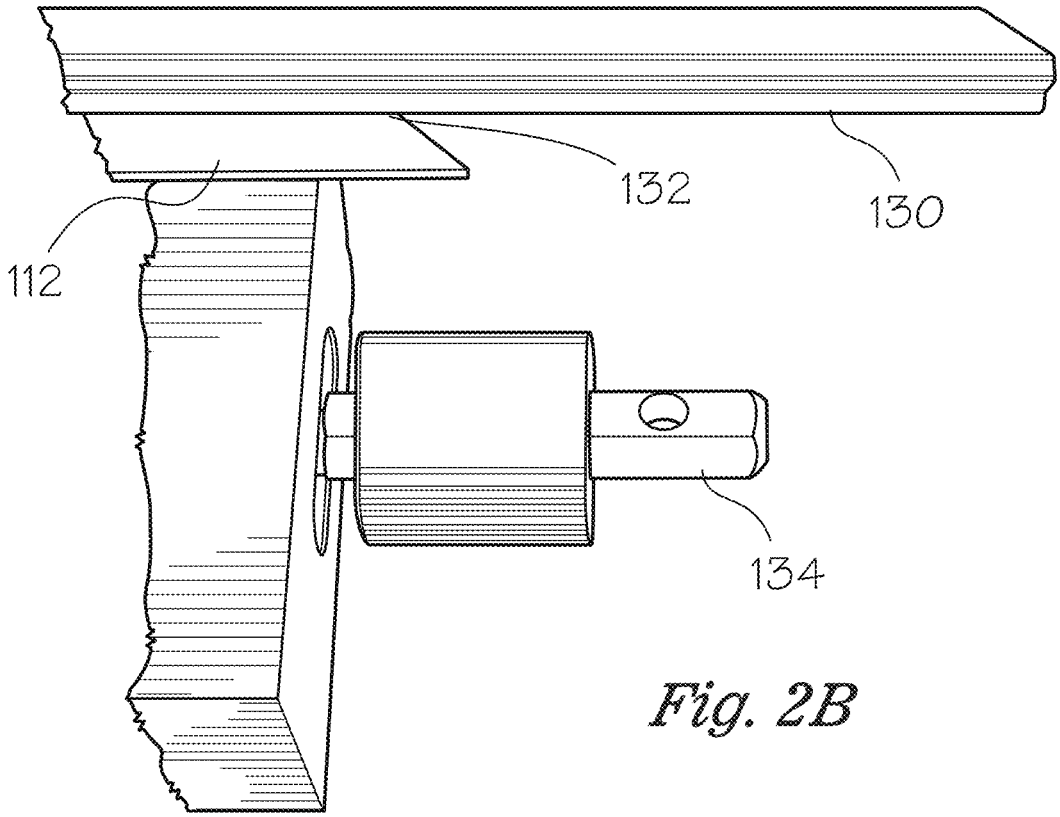
FIG. 2B shows a screen affixment mechanism of the current disclosure affixed to a standing ridge and moved horizontally.

Referring to FIG. 2A, which shows an end view of a rail with screen affixment mechanism 130 separated from standing ridge 132. In use, screen affixment mechanism 130 covers standing ridge 132 of substantially continuous spline 112 and second substantially continuous spline 118. Screen affixment mechanism 130 affixes vertically to standing ridge 132. Once attached, screen affixment mechanism 130 is capable of horizontal movement along standing ridge 132, see FIG. 2B. At least one mechanical tenon 134 may be substantially entirely contained within the material forming the at least one stile and at least one rail forming the at least one joint. For purposes of example only and not intended to be limiting, first rail 102 and first stile 108 may form joint 122 with mechanical tenon 134 residing substantially completely within the wood forming joint 122. In one embodiment, a mechanical tenon may be a Festool® tenon available from Festool USA, 400 N. Enterprise Blvd, Lebanon, Ind. 46052. FIG. 2B shows screen affixment mechanism 130 affixed to standing ridge 132 and moved horizontally beyond end of substantially continuous spline 112.

Figure 3:
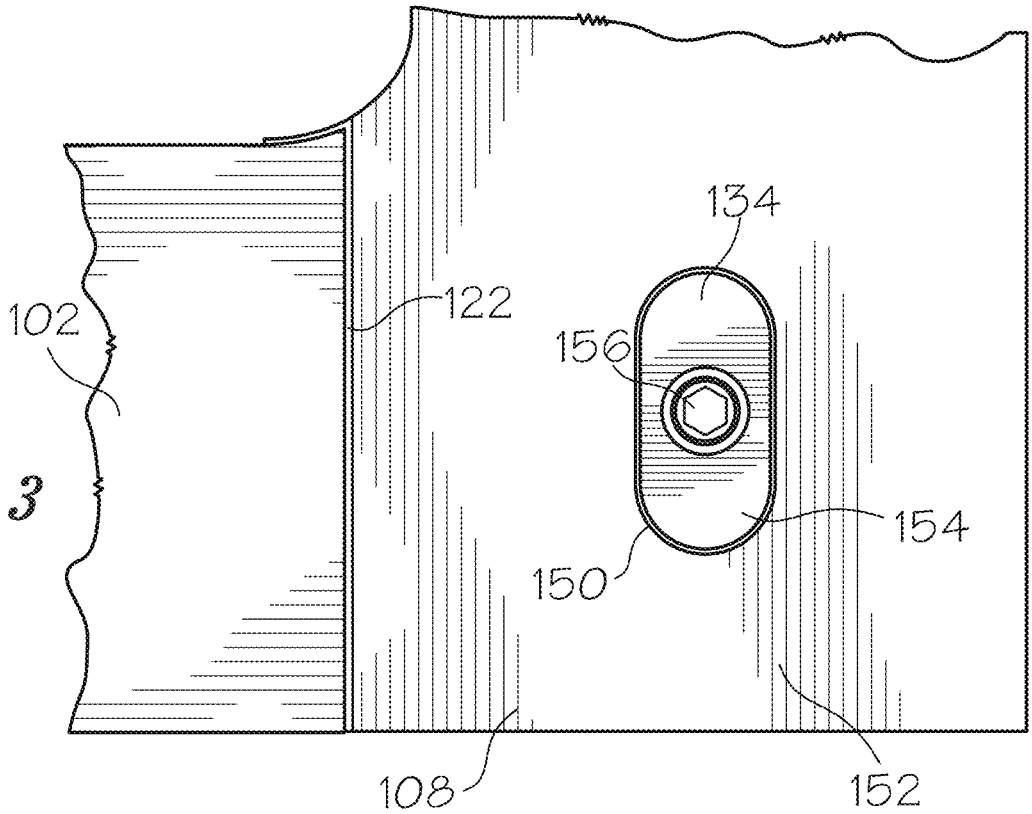
FIG. 3 shows an enlarged rear view of a first rail joined with a first stile to form a joint.

FIG. 3 shows an enlarged rear view of first rail 102 joined with first stile 108 to form joint 122. Access 150 may be defined within lower surface 152 of first stile 108. Access 150 may come in a variety of shapes with the only constraint on the shape being that access may be afforded to allow insertion of tightener mechanism 154 of mechanical tenon 134. In a preferred embodiment, access 150 is oval in shape. In a preferred embodiment, tightener mechanism 134 may comprise a hex nut head threaded bolt 156. Tightening of bolt 156 into mechanized tenon 134 results in pulling joint(s) 122 tighter together via action of tenon 134 as described infra. Loosening bolt 156 allows for separating joint 122 in order to readjust or disassemble screen door 100.

Figure 4:
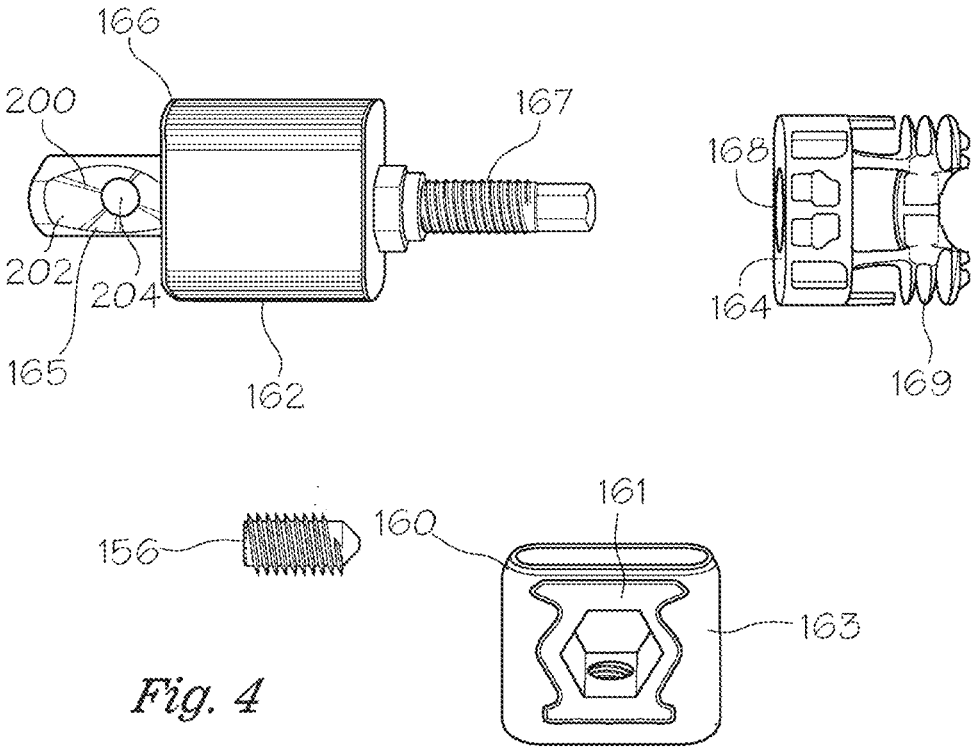
FIG. 4 shows a disassembled mechanical tenon of the current disclosure.
Figure 5A:
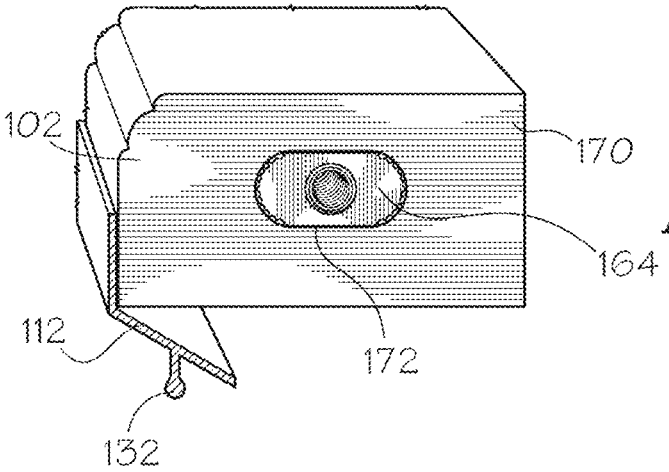
FIG. 5A illustrates an end view of a rail of the current disclosure.

With respect to FIG. 4, showing a disassembled mechanical tenon 134, mechanical tenon 134 may comprise three distinct sections in addition to hex nut head threaded bolt 156. This includes tightener mechanism 160, which in turn includes threaded receiver 161, housing 163, and tenon connector 162, which includes bolt receiving surface 165, connector housing 166, and threaded insertion end 167, and expanding anchor 164, which includes threaded receiving opening 168 and expanding flanges 169. In use, see FIG. 5A, expanding anchor 164 is inserted into rail joint end 170 via anchor housing cavity 172, such as for purposes of example only and not intended to be limiting, first rail 102. Also, as FIG. 5A shows, substantially continuous spline 112 may be formed at a right angle and affix to two sides of the rail or stile to which it is affixed with standing ridge 132 extending substantially perpendicular from substantially continuous spline 112. Spline 112 and/or 118 may be affixed to the rails and stiles of the current disclosure via screws, nails, brads, adhesives, etc., as known to those of skill in the art.

Figure 5B:
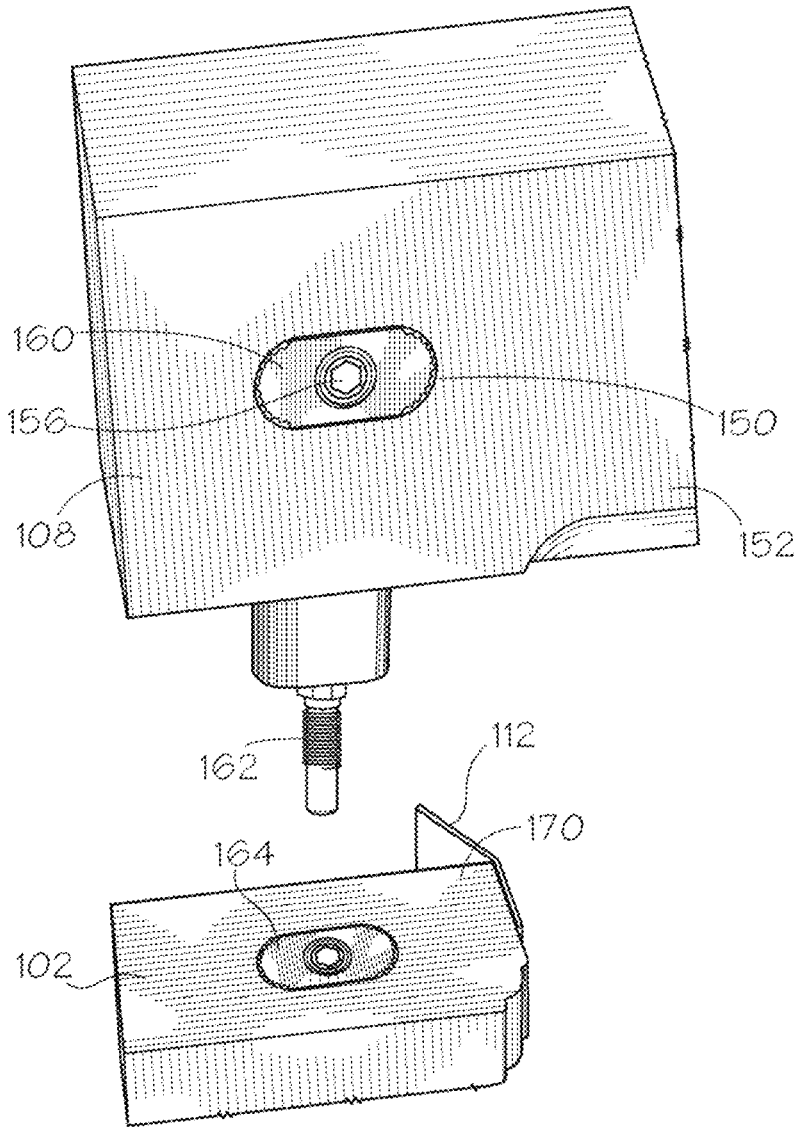
FIG. 5B shows a disassembled first rail in proximity to a first stile with a tenon connector not fully inserted into first stile.
Figure 5C:
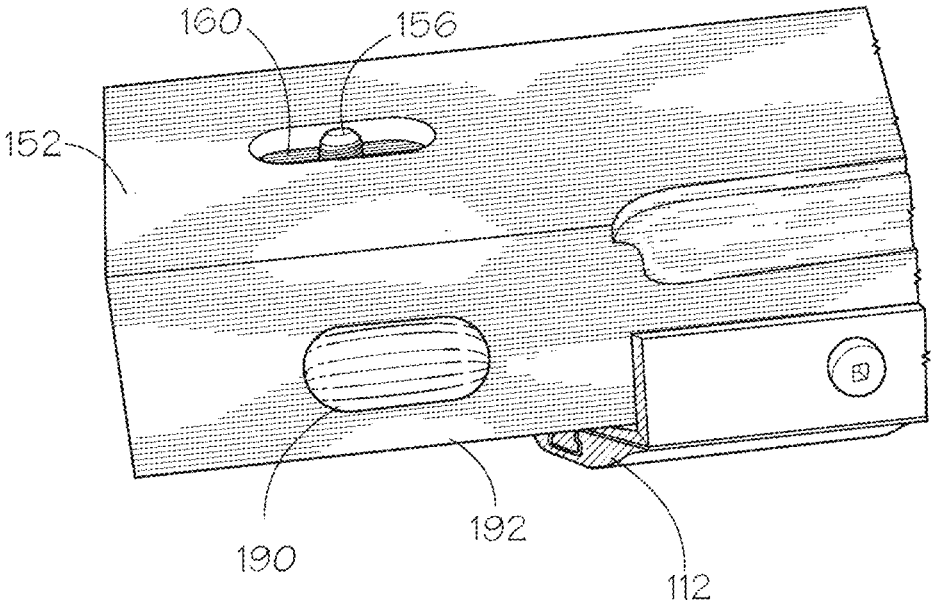
FIG. 5C shows an end view of a stile of the current disclosure.

Now referring to FIG. 5B, which shows a disassembled first rail 102 in proximity to first stile 108 with tenon connector 162 not fully inserted into first stile 108. Connector tenon 162 is inserted into first stile 108 via stile opening 190 located in stile joint end 192, see FIG. 5C, and tightener mechanism 160 is inserted into access 150 in lower surface 152 of stile 108.

During use, tightener mechanism 160 is frictionally secured within access 150 via interaction between housing 162 and the material forming access 150. Meanwhile, tenon connector 162 has been inserted or threaded into expanding anchor 164 via threaded receiving opening 168. Expanding anchor 164 is frictionally engaged with anchor housing cavity 172 via expanding flanges 169 pushing against the material forming housing cavity 172.

To assemble joint 122, a user may use a hex head wrench, not shown, to turn threaded bolt 156. Bolt 156 proceeds through threaded receiver 161 and engages bolt receiving surface 165 of tenon connector 162. Threading bolt 156 into the bolt receiving surface 165 causes bolt 156 to engage concave surface 200 of bolt receiving surface 165. As bolt 156 is tightened and moves deeper into threaded receiver 161, concave engager 200 is "pulled" toward bolt 156, as well as causing first rail 102 to pull toward first stile 108 and tighten joint 122, as bolt 156 slides down slanted surface 202 of concave engager 200 toward engagement cavity 204.

The insertion of tenon connector 162 into expanding anchor 164 causes the anchor to expand within stile opening 190 as well as to also "pull" toward tightener mechanism 160 when tenon connector 162 "pulls" toward tightener 160 due to the movement of bolt 156 on slanted surface 202. Connector housing 166 resides within stile opening 190 and serves to keep tenon connector 162 aligned with tightener mechanism 160.

If the door were to become loose during use, all a user would need to do to tighten the door is unscrew bolt 156 and separate joint 122. Then the user may screw or insert tenon connector 162 further into expanding anchor 164, causing anchor 164 to expand and better secure itself within first rail 102 by deeper engagement of expanding flanges 190 into the material of the rail containing expanding anchor 164. The user may then reassemble joint 122 and turn bolt 156 to again tighten the joint. If the door joint were to become loose the user would simply retighten bolt 156 with a hex head wrench. Function of mechanical tenon: expanding anchor 164 is inserted into mortise then threaded insertion end 167 is screwed into expanding anchor 164 thus expanding the anchor into the material securing it.

Figure 6A:
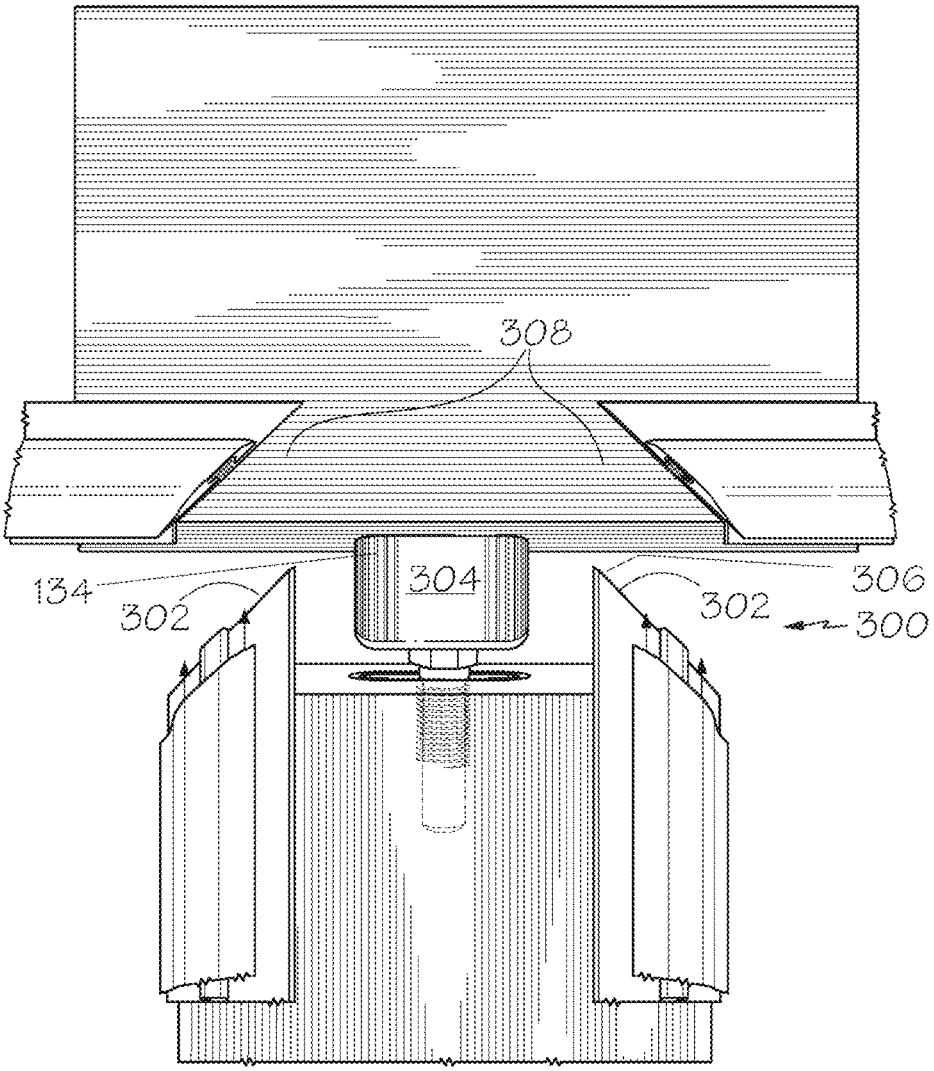
FIG. 6A shows a second rail engaged with a first stile but not tightened.

Another innovation of the current disclosure is the use of a paired stabilizing system. Referring to FIG. 6A, which shows second rail 104 assembled to first stile 108 but not tightened, illustrates paired stabilizing system 300. System 300 uses mechanical tenon 134 in association with spline stabilization fins 302 to provide both an internal support 304 and external support 306. As spline 112 and 118 are formed from a rigid material such as aluminum, they not only serve to secure a screen to the door but they also serve to structurally strengthen screen door 100. In use, internal support 304 will work in conjunction with external support 306 to prevent torsional stresses, as well as other stresses, on screen door 100. Internal support 304 stabilizes rail 104 and stile 108 by providing internal stabilization within the material(s) forming rail 104 and stile 108. Additionally, stabilization fins 302 extend onto stabilization platform(s) 308 on stile 108 in order to secure stile 108 in substantially the same plane as rail 104 to prevent rotational and/or torsional stresses from being placed on joint 122. In a further embodiment, stabilization fins 302 may be further secured via self-tapping screws or other connectors as known to those of skill in the art. By combining both an internal support 304 and external support 306, either by a single stabilization fin 302 or double stabilization fins 302 as shown in FIG. 6A, screen door 100 is extremely strong and stable in use. This, in addition to the ability to retighten joints during use, provides a novel and nonobvious solution over existing devices.

Figure 6B:
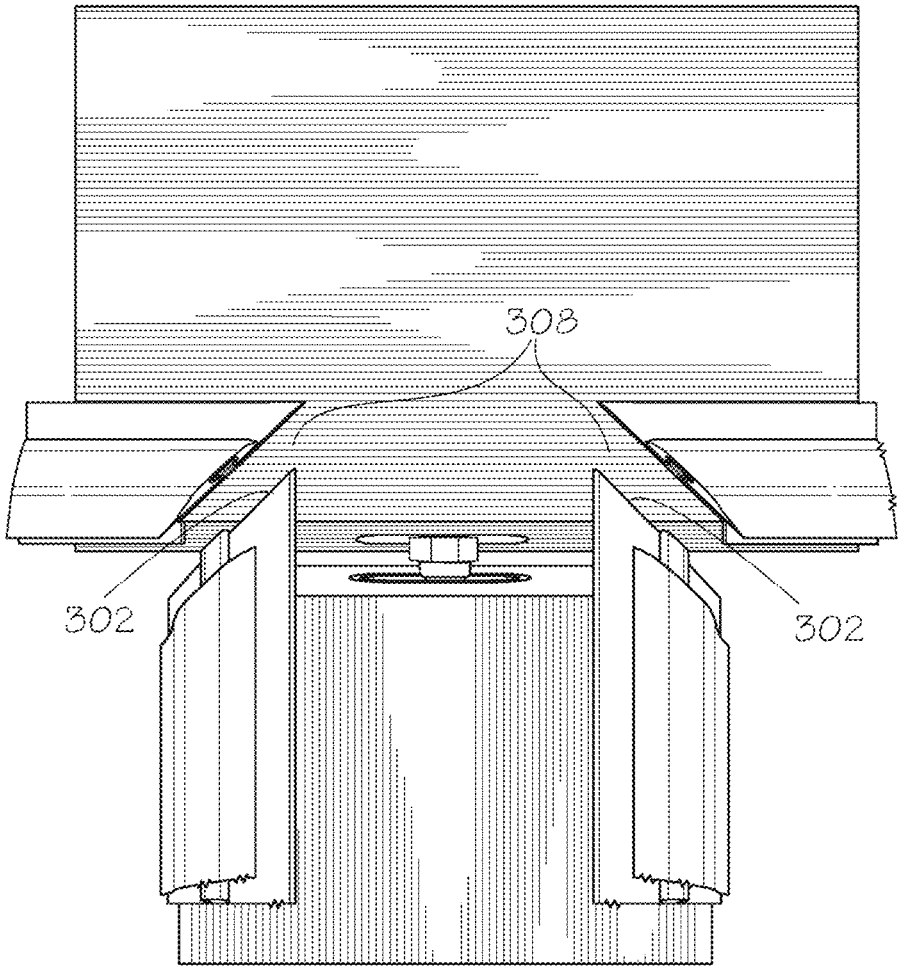
FIG. 6B shows a second rail in a partially tightened formation where the second rail is being drawn toward the first stile.
Figure 6C:
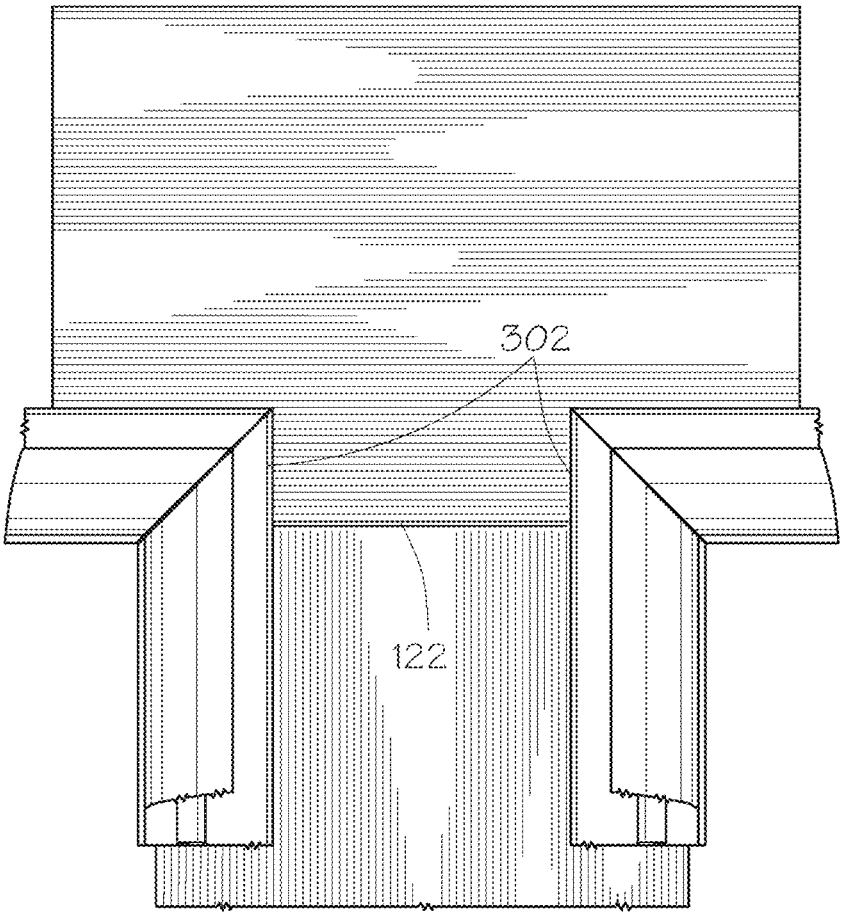
FIG. 6C shows a rail joined to a stile to form a joint.

FIG. 6B shows rail 104 in a partially tightened formation where second rail 104 is being drawn toward first stile 108 via action of bolt 156, as described supra. Stabilization fins 302 are shown partially overlaying stabilization platforms 308. FIG. 6C shows rail 104 joined to stile 108 to form joint 122. Here, stabilization fins 302 are in place on stabilization platforms 308.

Figure 7A:
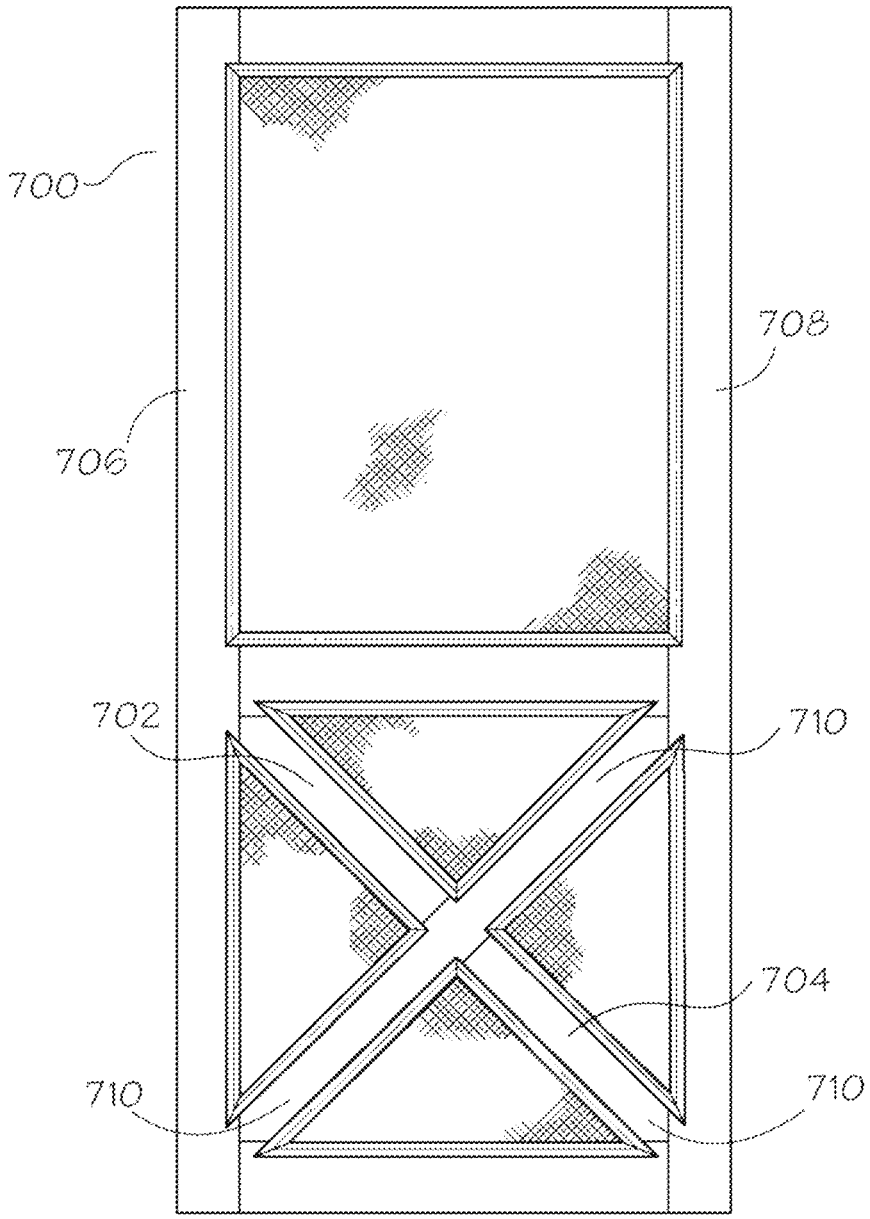
FIG. 7A shows an alternative embodiment of the current disclosure screen door with an additional fourth rail and fifth rail positioned at an angle to the door stiles.
Figure 7B:
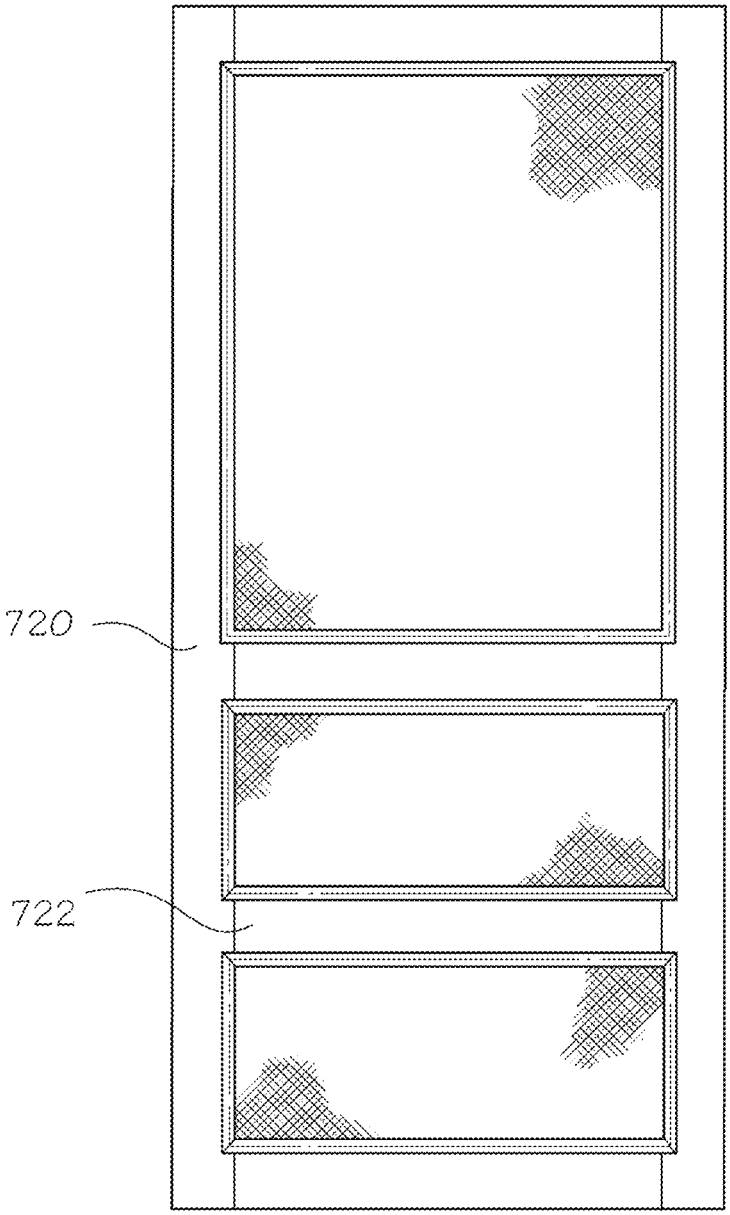
FIG. 7B shows a further alternative embodiment of the current disclosure wherein the screen door includes an additional horizontal stile.
Figure 7C:
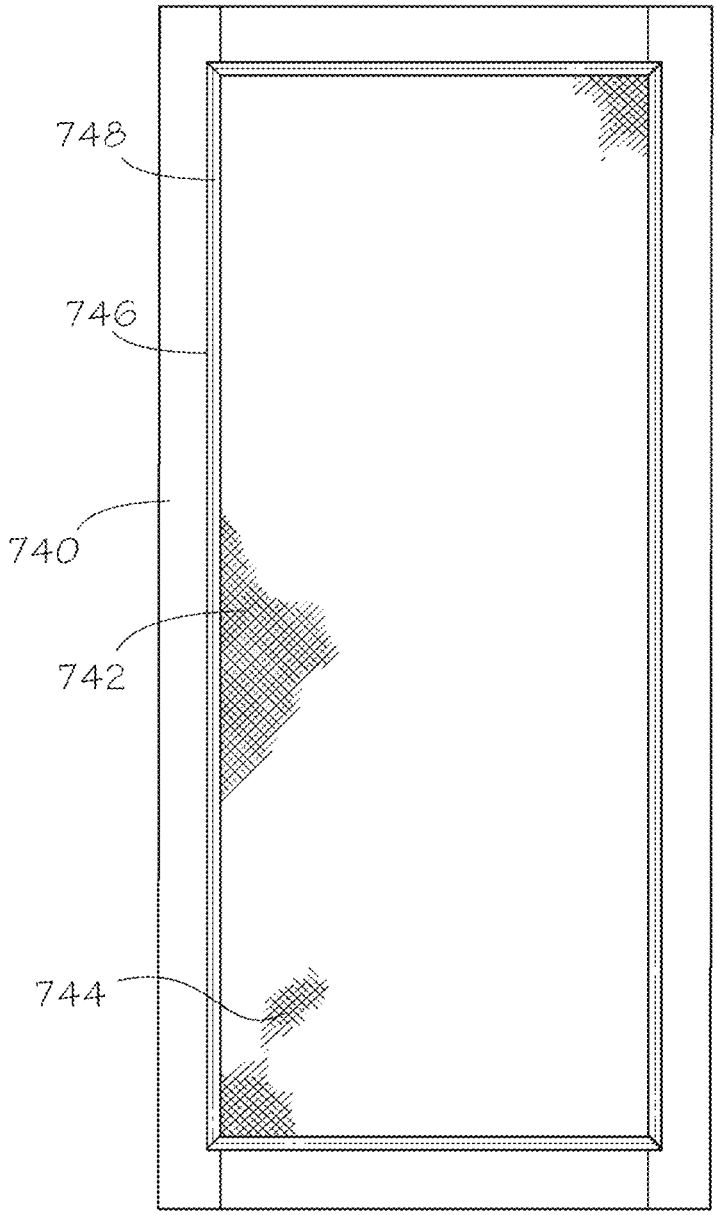
FIG. 7C shows an alternative embodiment wherein the screen door only has two rails and defines an open frame for a screen.
Figure 7D:
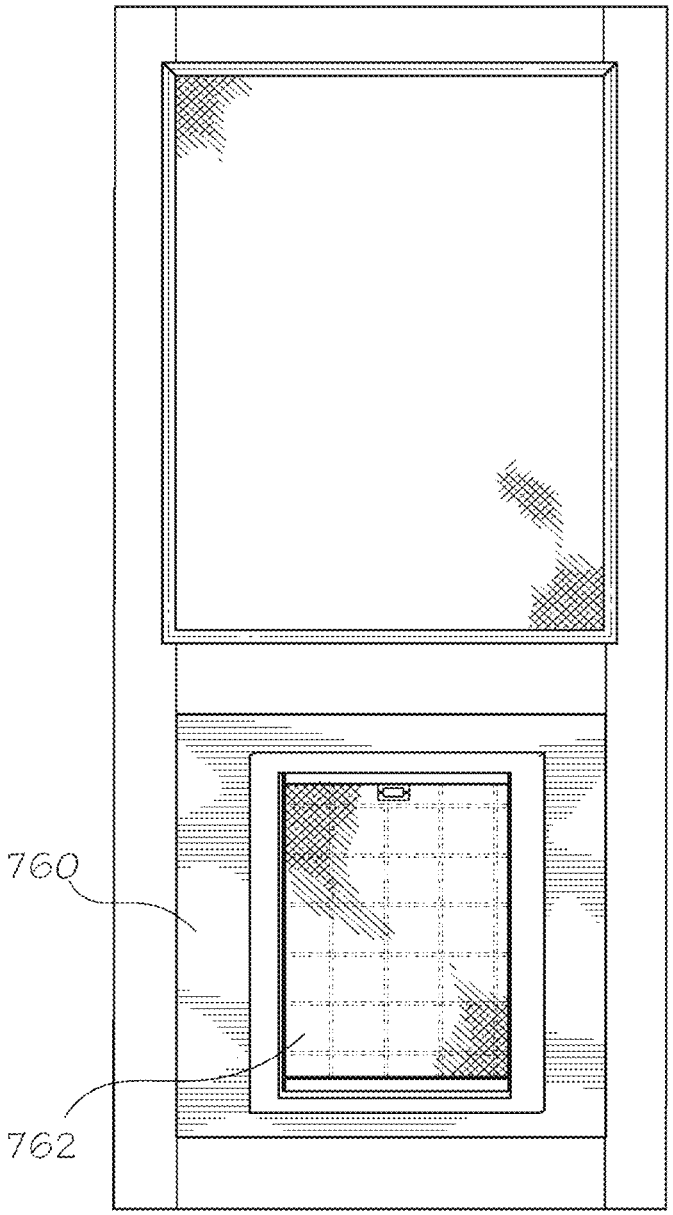
FIG. 7D shows a "doggy door" attachment that may be integrated into a screen door of the current disclosure.

FIGS. 7A-7D show alternative embodiments of a screen door of the current disclosure. FIG. 7A shows screen door 700 with additional fourth rail 702 and fifth rail 704 that are positioned at an angle to stiles 706 and 708. In one embodiment, fourth rail 702 and fifth rail 704 may be formed integrally with stiles 706 and 708, thus lacking joints. In a further embodiment, angled joints 710 may be formed and secured via mechanical or wood tenons, which may be used to create this design. FIG. 7B shows screen door 720 which includes an additional horizontal stile 722. FIG. 7C shows screen door 740 that only has two rails and defines an open frame 742 for screen 744. Here, only a single perimeter 746 is defined by substantially continuous spline 748. FIG. 7D shows a "doggy door" 760 attachment that may be integrated into a screen door of the current disclosure includes an ingress/egress 762 for an animal through the door. A dado in the door frame allows the addition of a panel. The panel will have an opening that allows the installation of a dog door. This panel may be solid also, wherein a portion of the door or all panels of the door may also be solid.

Figure 7E:
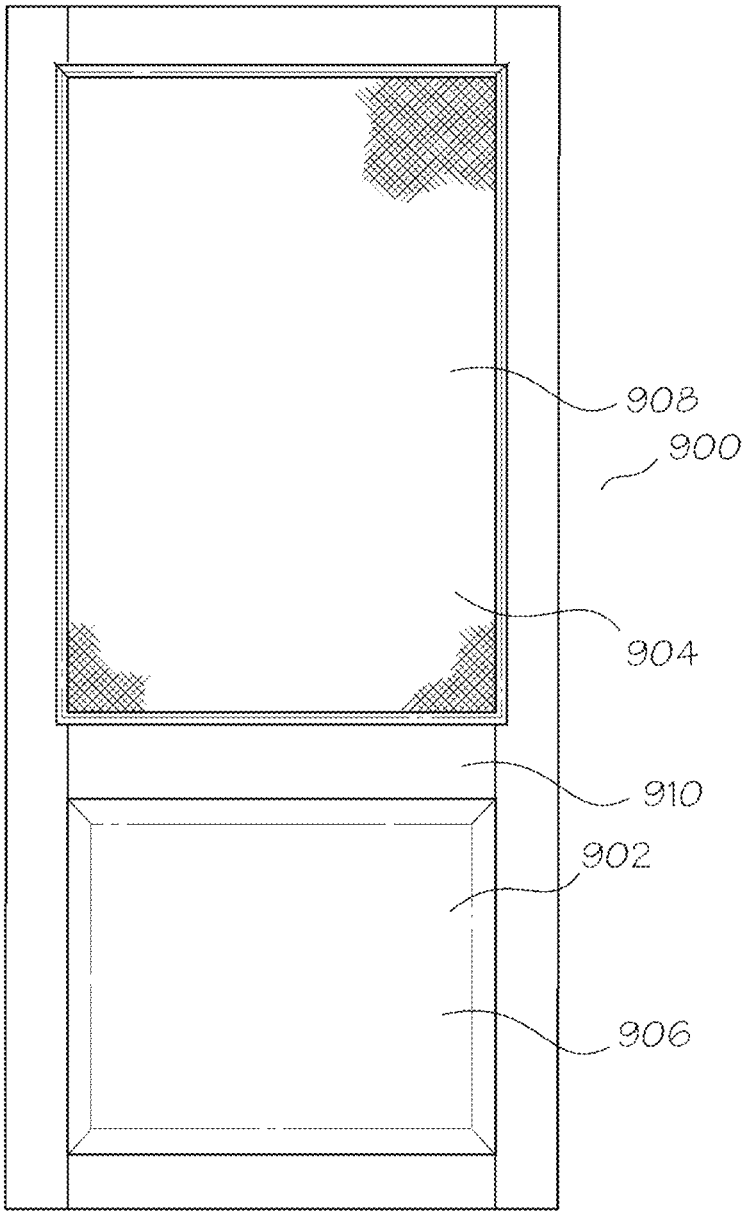
FIG. 7E shows an alternative screen door wherein a solid panel may be used to replace the door screen(s).

FIG. 7E shows an alternative screen door 900 wherein solid panel 902 may be used to replace screen 904. While FIG. 7E shows solid panel 902 occupying lower area 906 of alternative screen door 900, solid panel 902 may also be placed within upper area 908 in place of screen 904. In a still further embodiment, solid panel 902 may be a single large panel that occupies the space defined by both lower area 906 and upper area 908, as well as rail 910.

Figure 8:
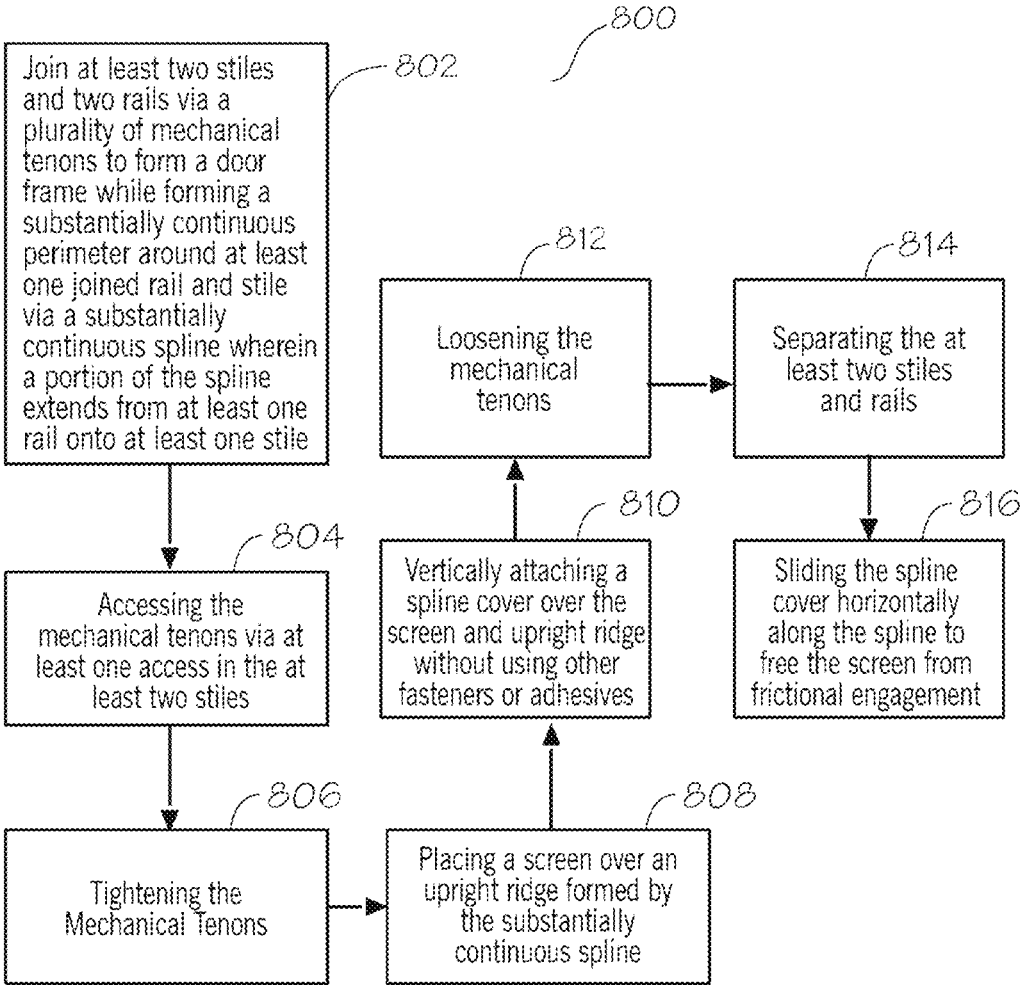
FIG. 8 shows a method for assembling and disassembling a screen door of the current disclosure.

In a further embodiment, see FIG. 8, a method 800 is provided for forming a screen door and disassembling same. At step 802, at least two stiles are joined with at least two rails via a plurality of mechanical tenons to form a plurality of joints and a door frame. Further, a substantially continuous spline forms at least one perimeter around at least one joined stile and at least one rail of the at least two stiles and at least two rails and wherein a portion of the spline attached to at least one rail extends onto at least one stile. At step 804, the mechanical tenons are accessed via at least one access formed in the at least two stiles. At step 806, the mechanical tenons are tightened. At step 808, a screen is placed over an upright ridge formed by the substantially continuous spline. At step 810, a spline cover is vertically attached over the screen and upright ridge in order to frictionally secure the screen between the spline cover and upright ridge without the need for other fasteners or adhesives. To disassemble, at step, 812, the mechanical tenons are loosened. At step 814, the at least two stiles and at least two rails are separated. At step 816, the spline cover is pried up from the spline slid horizontally along the spline to free the screen from frictional engagement.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A screen door comprising:

at least two rails and at least two stiles formed from a material;

a substantially continuous spline forming at least one perimeter around at least one of the at least two rails and at least one of at least two stiles;

a screen affixment mechanism that covers a standing ridge of the substantially continuous spline;

wherein the at least two rails and at least two stiles form at least two joints;

at least one mechanical tenon substantially contained within the material of at least one of the at least two joints formed by at least one of the at least two stiles and at least one of the at least two rails, wherein the at least one mechanical tenon comprises:

a tightener mechanism;

a threaded receiver; and an expanding anchor extending substantially perpendicularly with respect to the tightener mechanism;

at least one access defined within the at least two stiles; and wherein the mechanical tenon is selectively tightened and loosened via engaging the mechanical tenon via the at least one access.

2. The screen door of claim 1, wherein the substantially continuous spline on the at least one rail extends onto the material of the at least one stile to which the at least one rail is connected.

3. The screen door of claim 1 with at least three rails.

4. The screen door of claim 1, wherein the joints are square cut.

5. The screen door of claim 1, wherein the screen door is disassembled via accessing the at least one mechanical tenon.

6. The screen door of claim 1, wherein a screen is affixed to the spline via frictional engagement between the standing ridge and the screen affixment mechanism.

7. The screen door of claim 1, wherein adjustment of the at least one mechanical tenon tightens or loosens the at least one joint.

8. An adjustable assembly comprising:

at least two rails and at least two stiles formed from a material;

wherein the adjustable assembly includes at least one set of paired stabilizers, a first stabilizer placed internally within the material of at least one joint formed by a junction of at least one rail and at least one stile and a second stabilizer formed by overlap of a spline from a surface of at least one rail onto a surface of at least one stile over an exterior of the at least one joint;

wherein the spline forms at least one perimeter around at least one of the at least two rails and at least one of the at least two stiles;

a spline cover that vertically engages the spline and moves horizontally along the spline; and at least one mechanical tenon is substantially contained within the material of the at least one stile and at least one rail forming the at least one joint wherein the at least one mechanical tenon is selectively tightened and loosened and comprises:

a tightener mechanism;

a threaded receiver; and an expanding anchor extending substantially perpendicularly with respect to the tightener mechanism.

9. The adjustable assembly of claim 8, wherein at least one access is defined within the at least two stiles.

10. The adjustable assembly of claim 9, wherein the mechanical tenon is selectively tightened and loosened via engaging the mechanical tenon via the at least one access.

11. The adjustable assembly of claim 8, wherein adjustment of the at last one mechanical tenon tightens or loosens the at least one joint.

12. The adjustable assembly of claim 8 comprising at least three rails.

13. The adjustable assembly of claim 8, wherein the joints are square cut.

14. The adjustable assembly of claim 8, wherein the door is disassembled via accessing the at least one mechanical tenon.

15. The adjustable assembly of claim 8, wherein a screen is affixed to the spline via frictional engagement between a standing ridge of the spline and a screen affixment mechanism.

16. A process for assembling a screen door comprising:

joining at least two stiles with at least two rails via a plurality of mechanical tenons to form a plurality of joints wherein each of the plurality of mechanical tenons is selectively tightened and loosened and comprises:

a tightener mechanism;

a threaded receiver; and an expanding anchor extending substantially perpendicularly with respect to the tightener mechanism;

forming at least one perimeter at least one perimeter around at least one joined stile and at least one rail of the at least two stiles and at least two rails via a substantially continuous spline wherein a portion of the spline attached to at least one rail extends onto at least one stile;

accessing the mechanical tenons via at least one access formed in the at least two stiles;

tightening the mechanical tenons;

placing a screen over an upright ridge formed by the substantially continuous spline;

vertically attaching a spline cover over the screen and upright ridge in order to frictionally secure the screen between the spline cover and upright ridge without other fasteners or adhesives.

17. The process of claim 16, wherein the screen door is disassembled by;

loosening the mechanical tenons;

separating the at least two stiles and rails; and sliding the spline cover horizontally along the spline to free the screen from frictional engagement.

* * * * *